US009663197B2

(12) United States Patent
Bires

(10) Patent No.: US 9,663,197 B2
(45) Date of Patent: May 30, 2017

(54) BOAT TABLE

(71) Applicant: Longpointe Nautical LLC, Lake Orion, MI (US)

(72) Inventor: Michael J. Bires, Lake Orion, MI (US)

(73) Assignee: Longpointe Nautical LLC, Lake Orion, MI (US)

( * ) Notice: Subject to any disclaimer, the term of this patent is extended or adjusted under 35 U.S.C. 154(b) by 0 days.

(21) Appl. No.: 15/006,529

(22) Filed: Jan. 26, 2016

(65) Prior Publication Data

US 2016/0214690 A1 Jul. 28, 2016

Related U.S. Application Data

(60) Provisional application No. 62/108,713, filed on Jan. 28, 2015.

(51) Int. Cl.
*B63B 29/04* (2006.01)

(52) U.S. Cl.
CPC ..... *B63B 29/04* (2013.01); *B63B 2029/046* (2013.01)

(58) Field of Classification Search
CPC ..... B63B 17/00; B63B 29/00; B63B 29/04; B63B 29/06; B63B 29/08
USPC ..... 114/195, 253, 343, 364
See application file for complete search history.

(56) References Cited

U.S. PATENT DOCUMENTS

| | | | | |
|---|---|---|---|---|
| 2,604,930 | A | 7/1952 | Dean et al. | |
| 3,925,836 | A * | 12/1975 | Simmonds | B63B 35/85 114/254 |
| 4,086,859 | A | 5/1978 | Dondero | |
| 4,672,898 | A | 6/1987 | Davidson | |
| 4,989,535 | A | 2/1991 | Lacasse et al. | |
| 5,092,263 | A | 3/1992 | Hutchison et al. | |
| 5,197,406 | A | 3/1993 | Rabal et al. | |
| 6,101,966 | A | 8/2000 | Cumisky | |
| 6,866,001 | B1 | 3/2005 | Cuccia | |
| 7,370,599 | B1 | 5/2008 | Berman et al. | |
| 7,389,738 | B1 | 6/2008 | Walczykowski | |
| 7,458,331 | B2 | 12/2008 | Zsido | |
| 8,371,548 | B1 | 2/2013 | Bishop | |
| 8,668,096 | B2 | 3/2014 | Von De Linde | |
| 2012/0048149 | A1 | 3/2012 | Pendleton | |
| 2013/0299667 | A1 | 11/2013 | Casagrande | |

OTHER PUBLICATIONS

"Deck Mount Installation Stowable Cockpit Table—Garelick 75405," www.iboats.com, Nov. 12, 2014, 1 page.
"2012 Bennington 20 SF Pontoon Boat," www.benningtonmarine.com, Nov. 12, 2014, 1 page.
"Magma T10-311 Econo Mate Bait & Filet Table 12in × 16in," www.tackledirect.com, Dec. 2, 2014, 1 page.
(Continued)

*Primary Examiner* — Lars A Olson
(74) *Attorney, Agent, or Firm* — Harness, Dickey & Pierce, P.L.C.

(57) ABSTRACT

A boat apparatus includes an aesthetically pleasing table and a generally horizontal member to which it is mounted. In another aspect, a table is mounted to a ski rope tow bar. Another aspect provides a table mounted to a side rail such that at least a majority of the table projects outboard from a seating area.

43 Claims, 12 Drawing Sheets

(56) References Cited

OTHER PUBLICATIONS

"TACO 32in Poly Filet Table w/Adjustable Gunnel Mount—P01-2132W," www.tackledirect.com, Dec. 2, 2014, 1 page.
"Deep Blue Marine Rigging Stations and Tools," www.alltackle.com, Dec. 2, 2014, 5 pages.
"Accessories—Aqua Cycle SW Pontoon Paddle Boats," vwww.aquacyclesw.com, Nov. 12, 2014, 2 pages.
"Godfrey Polished Stainless Steel 45 1/4 Inch Pontoon Boat Ski Pylon/Bar," http://greatlakesskipper.com, Nov. 12, 2014, 1 page.
"Toonmate Premium Large Kidney-Shaped Pontoon Table with Two Legs," www.gandermountain.com, Nov. 12, 2014, 2 pages.
"Installation Instructions for Portable Cockpit Tables," www.garelick.com, published on or before Nov. 12, 2014, 2 pages.
"Sundance FX17 Flicker," www.floridasportsman.com, Jan. 27, 2015, 12 pages.
"Poling a Flats Skiff," http://features.boats.com, Jan. 27, 2015, 2 pages.
"2015 Tahoe Catalog Photographs," www.tahoepontoons.com, published prior to Jan. 28, 2015, 6 pages.
"Stern Racks—Multi-Use Equipment Racks," www.saltbossmarine.com, Apr. 10, 2015, 8 pages.
"Building a Tricked-Out Flats Boat," www.sportfishingmag.com, Jan. 27, 2015, 2 pages.
"Marker One Platform Series M27," www.boatingmag.com, Dec. 16, 2014, 5 pages.
"Boat Tables and Harware," www.iboats.com, Nov. 12, 2014, 4 pages.
"Snapit! Marine," www.snapitproducts.com, Nov. 12, 2014, 41 pages.
Photographs, published or publically used before Jan. 5, 2016.

* cited by examiner

BOAT TABLE

CROSS-REFERENCE TO RELATED APPLICATIONS

This application claims priority to U.S. Provisional Application No. 62/108,713, filed on Jan. 28, 2015, which is incorporated by reference herein

BACKGROUND AND SUMMARY

The present disclosure relates generally to boat apparatuses and more specifically to a boat table.

Various tables or utility mounting devices have been attempted for boats. Examples include those described in U.S. Pat. No. 4,086,859 entitled "Boat Table" which issued to Dondero on May 2, 1978; U.S. Pat. No. 6,101,966 entitled "Multipurpose Utility Station for Boat with Adjustable Mount" which issued to Cumisky on Aug. 15, 2000; U.S. Pat. No. 7,458,331 entitled "Table Mount for Boat" which issued to Zsido on Dec. 2, 2008; and U.S. Patent Publication No. 2012/0048149 entitled "Nautical Bar Server" which issued to Pendleton on Mar. 1, 2012. All of these are incorporated by reference herein. Most of these conventional devices take up considerable room within the seating area of the boat, require extraneous supports, and are not suitable for use with recreational pontoon boats.

In accordance with the present invention, a boat apparatus includes an aesthetically pleasing table and a generally horizontal member to which it is mounted. In another aspect, a table is mounted to a ski rope tow bar. Another aspect provides a table mounted to a side rail such that at least a majority of the table projects outboard from a seating area.

The boat table of the present invention is advantageous over conventional devices. For example, the present boat table is ideally suited for use with pontoon boats without obstructing the seating area thereof. The present boat table is also advantageous by being mounted to a ski rope tow bar, but without obstructing access of a ski rope attached thereto, thereby providing a multifunctional assembly. This reduces cost, is aesthetically improved by covering the conventional structural appearance of ski rope tow bars, and provides a functional table surface in a previously unused area. In another aspect, a side rail mounted table advantageously can be removeably mounted with a foot engaging between existing structural members of a pontoon boat, thereby saving cost, parts and deck space. Moreover, the present table beneficially supports beverage cups and plates for the boat occupants in an aesthetically pleasing manner but again, without encroaching upon the normally used deck space of a pontoon boat. The table adds previously unused article retention space of at least 10 $ft^2$. Additional advantages and features of the present invention can be ascertained from the following description and appended claims, as well as in the accompanying drawings.

DETAILED DESCRIPTION

Figure 1:
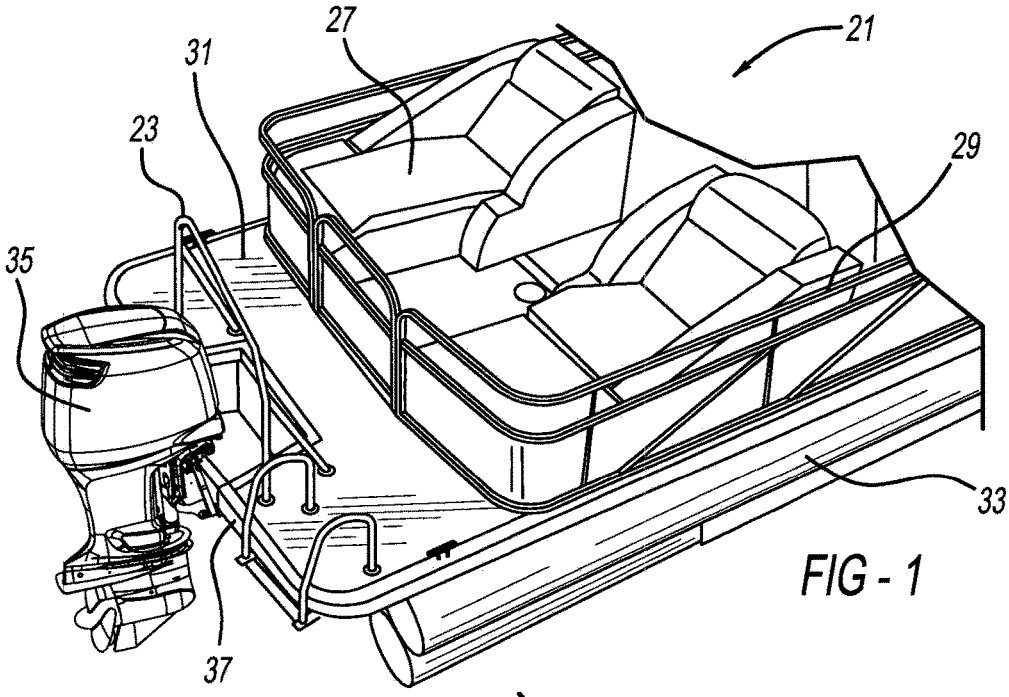
FIG. 1 is a perspective view showing a portion of a pontoon boat with a ski rope tow bar mounted adjacent an outboard motor.

FIGS. 1-5 illustrate a pontoon boat 21, a ski rope tow bar 23 and a table 25. Pontoon boat 21 has multiple seats 27 within a seating area bordered or surrounded by side rails 29. Pontoon boat 21 additionally has a generally flat and horizontal deck 31 upon which side rails 29 and seats 27 are mounted and upon which the boat occupants may walk when the boat is not in motion. Pontoons 33 are mounted to an underside to deck 31 and an outboard motor 35 is moveably mounted adjacent a rear edge 37 of pontoon boat 21.

Ski rope tow bar 23 includes a pair of generally vertical, upstanding tubular members 51 supporting a generally horizontally extending, tubular cross member 53 spanning therebetween. Offset angled, tubular support members 55 forwardly extend from each vertical member 51, although such additional support members 55 can be optionally omitted depending upon the diameter and materials used for the vertical members 51. Bottom ends 57 of members 51 and 55 are screwed to the deck, or alternately removeably mounted within cup-shaped apertures within deck 31.

Members 51, 53 and 55 are preferably stainless steel metal tubes which are integrally welded as a single piece. In a preferred exemplary embodiment, vertical members 51 have a spaced apart width of approximately 45 inches while horizontal member 53 is approximately spaced away from the deck by about 39 inches. Furthermore, the vertical members 51 preferably have a diameter of about 1.5 inches while support members 55 preferably have a diameter of about 1 inch. In another example, horizontal member 53 is spaced from deck 31 within the range of 30-48 inches. It should also appreciated that vertical members 51 and support members 55 may optionally have a rearwardly bent or angled configuration as they rise up from the boat deck.

Table 25 has a generally flat and horizontal table top 61 made of wood, fiberglass, metal, a composite laminate, or a sheet of polymeric material such as Conan®. The corners of table top 61 are curved, and metallic or polymeric beverage container holders 63 and other aesthetically pleasing dish retainers 65 may be optionally secured thereupon such as with threaded fasteners, adhesives or the like.

In the presently preferred embodiment, a pair of tubular metal bars 67 is fastened to an underside of table top 61, such as by screws. These bars 67 provide structural support and rigidity to table top 61 while also spacing the underside of table top 61 away from horizontal member 53 of ski rope tow bar 23 by at least 0.5 inch. This space allows unimpeded access to a water ski tow rope 71 removeably attachable to horizontal member 53, a flange or eyelet extending from member 53.

A bracket assembly 73 attaches each bar 67 to horizontal member 53. Each bracket 73 includes an upper bracket half 75 and a lower bracket half 77 which are fastened together by nut and bolt assemblies 79, rivets or the like. Each bracket half 75 and 77 has a generally U-shaped center section 81 which partially encircles bar 67 or horizontal member 53, and has generally flat outwardly extending flanges 83. The opening axis of bracket half 75 is generally perpendicular to that of bracket half 77, as best viewed in FIG. 5. An elastomeric or flexible rubber pad (like that shown in FIG. 10) is located between center sections 81 and the respective member 53 and bar 67.

Additionally, diagonal braces or arms 91 extend between and secure an outboard portion of table top 61 relative to vertical members 51. An upper end of each tubular brace 91 is flattened and pierced to accept a bolt or rivet for mounting to an upper pair of clamping brackets 93. Upper clamping brackets 93 each have a generally C-shaped central section bordered by pierced flanges such that the corresponding tubular bar 67 can be clamped therebetween. Lower clamping brackets 95, similarly configured to upper clamping brackets 93, serve to mount lower ends of diagonal braces 91 to vertical members 51 of ski rope tow bar 23. It should alternately be appreciated that bars 67 and braces 91 can have a solid polygonal cross shape and may be curved along their elongated length instead of the straight and hollow tubular configurations preferably disclosed hereinabove. The brackets 73, 93 and 95 allow for fore-aft, lateral and vertical sliding and pivoting adjustment along their respective members, such that the table assembly can fit to a variety of differently shaped tow bars.

It is noteworthy that the present ski rope tow bar and table assembly are positioned and constructed such that at least a majority of table 25 extends outboard of deck 31 of the pontoon boat thereby allowing the boat occupants to walk between the seating area and the table with minimal, if any, obstruction. Moreover, the present configuration advantageously positions at least a portion of table 25 above outboard motor 35 while still allowing for normal movement and tilting of outboard motor 35 relative to the boat without being impeded by the table. This beneficially provides multifunctional use of the ski boat tow bar for water ski tow rope attachment while the table remains in place.

Figure 6:
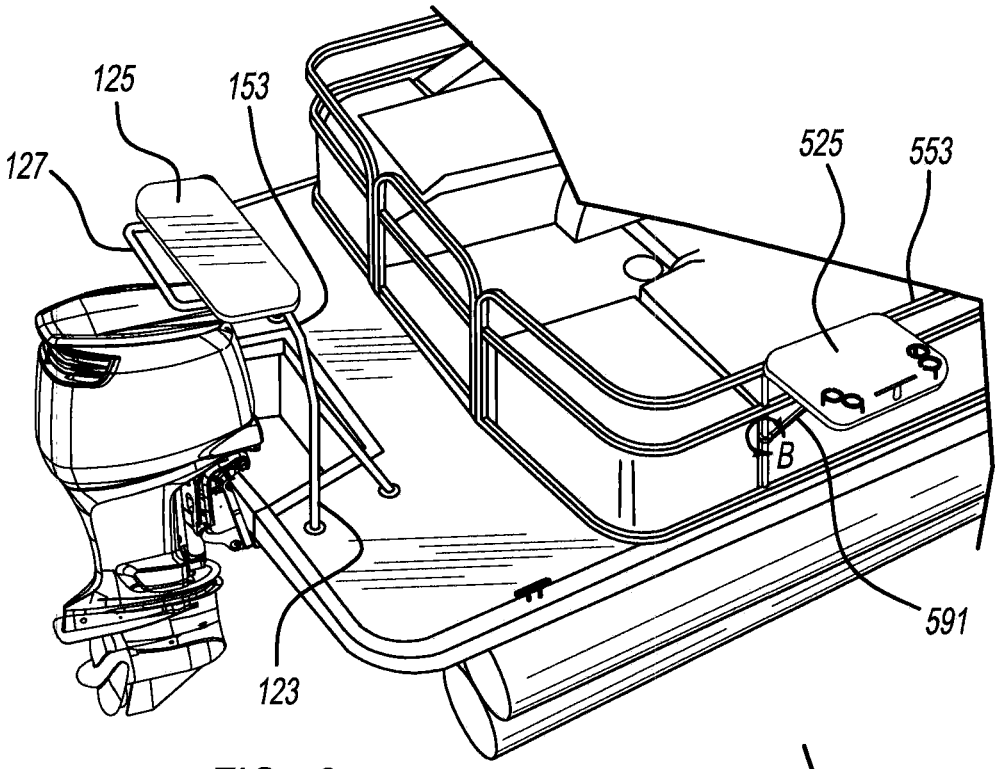
FIG. 6 is a perspective view showing a portion of a pontoon boat with a differently sized table attached to a ski rope tow bar and also showing a side rail mounted table.

Another configuration of the present boat apparatus is shown in FIG. 6. In this embodiment, table 125 is laterally longer but narrower in a fore and aft longitudinal direction as compared to the table of FIG. 2. Additionally, a U-shaped halo member 127 is welded to horizontal member 153 of tow rope bar 123. Halo member 127 is of hollow tubular construction and lies on a generally horizontal plane parallel to that of table 125. No diagonal brace is required for this version. It is noteworthy that the rearmost and laterally extending segment of halo member 127 serves to receive a water ski tow rope such that table 125 can be directly screwed to the longitudinally extending sections of halo member 127 without requiring a vertical space therebetween as with the prior embodiment.

Figure 7:
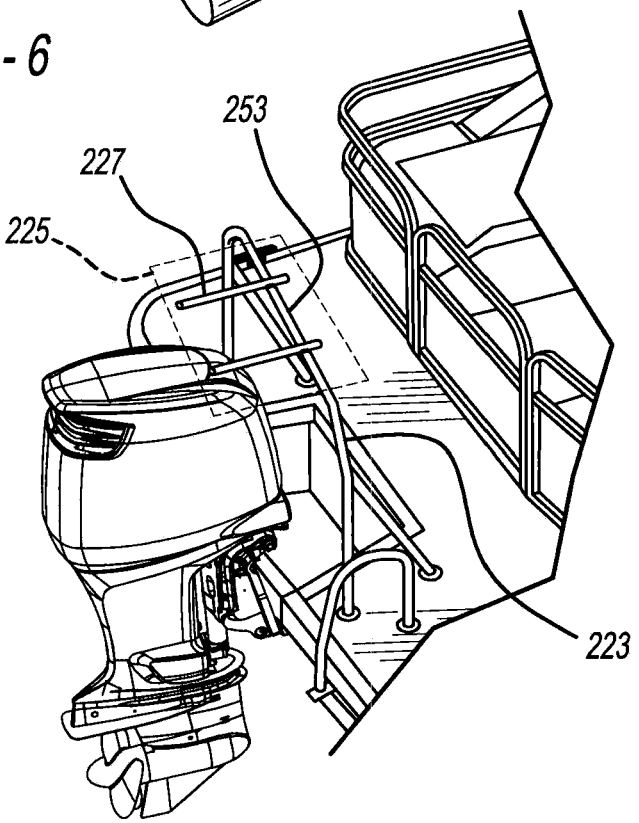
FIG. 7 is a perspective view showing a different variation of a ski rope tow bar for a table.

FIG. 7 illustrates yet another embodiment where two or more longitudinally extending structural members 227 are welded or otherwise fastened to a horizontal member 253 of a ski rope tow bar 223. A table 225 is mounted directly upon structural members 227. A vertical space for ski tow rope access fastening to horizontal member 253 is located therebelow. No diagonal brace is required for this version.

Figure 2:
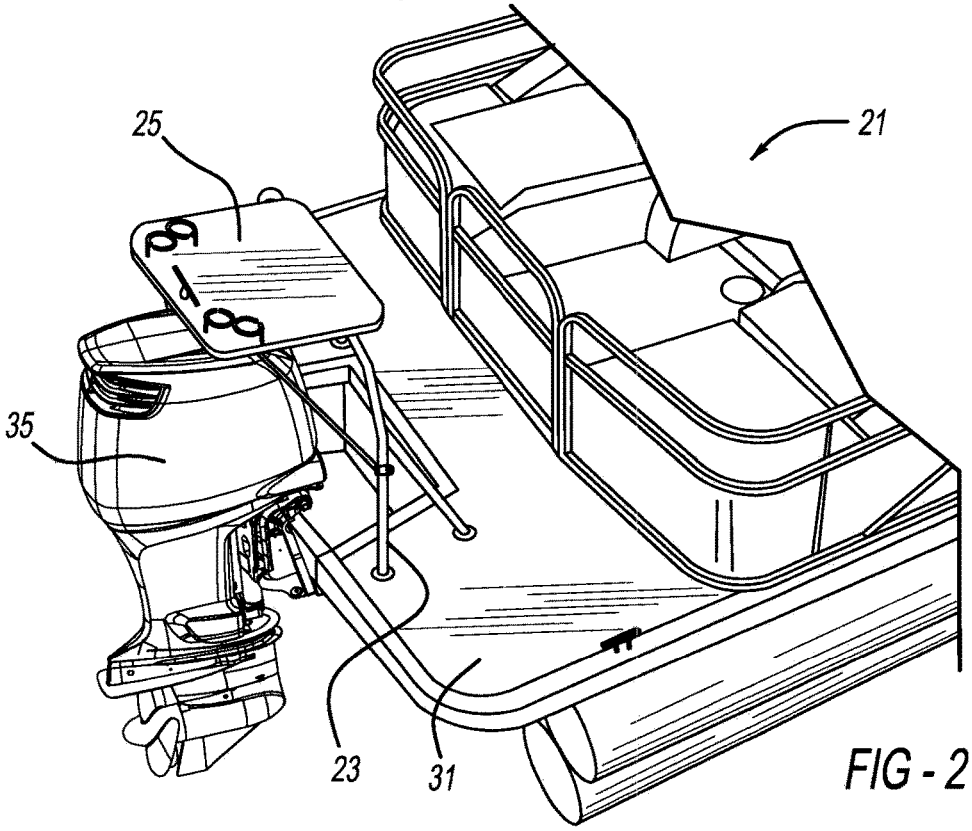
FIG. 2 is a perspective view showing a table mounted to the ski rope tow bar of FIG. 1.
Figure 3:
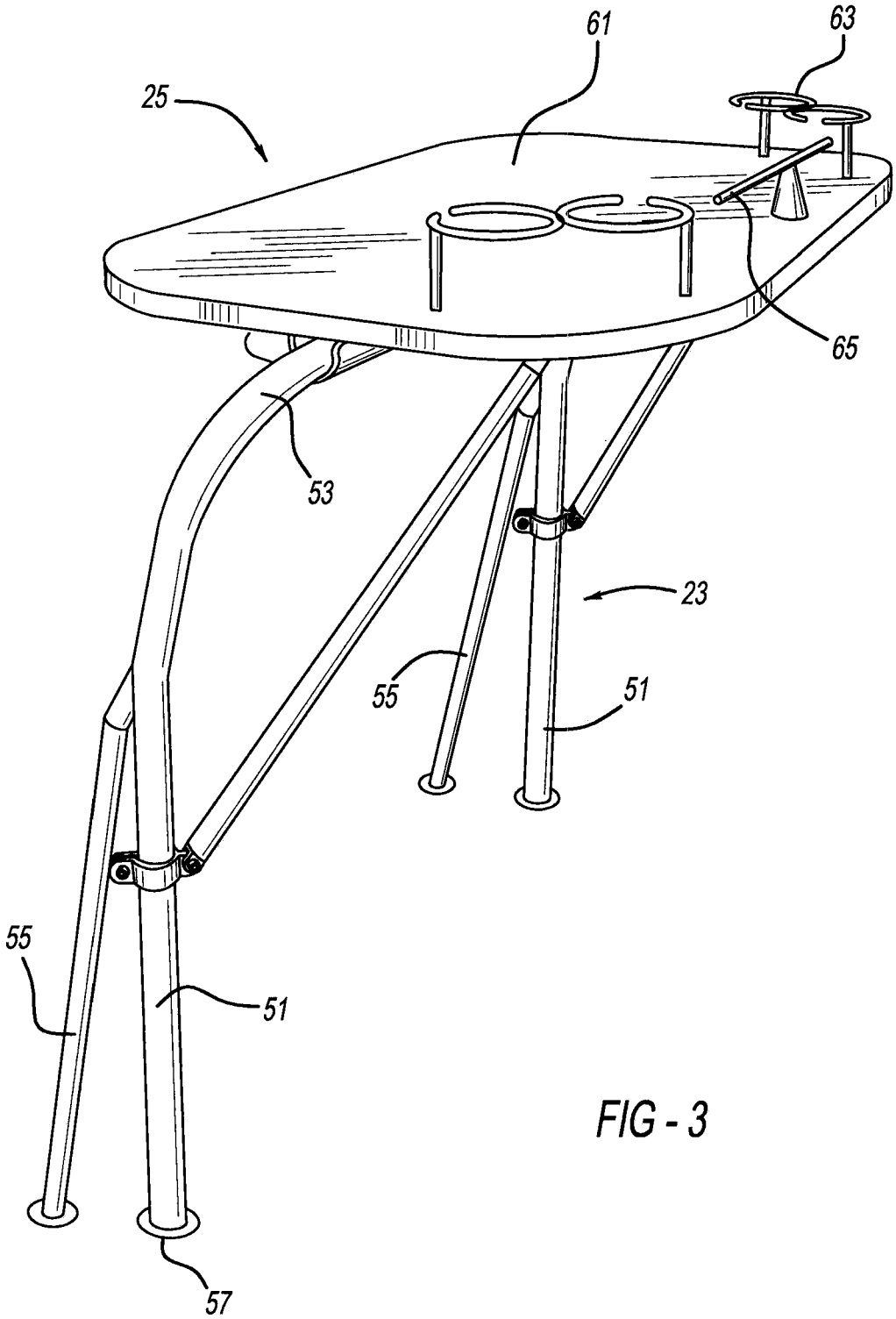
FIG. 3 is a top perspective view, taken opposite that of FIG. 2, showing the table and ski rope tow bar assembly.
Figure 4:
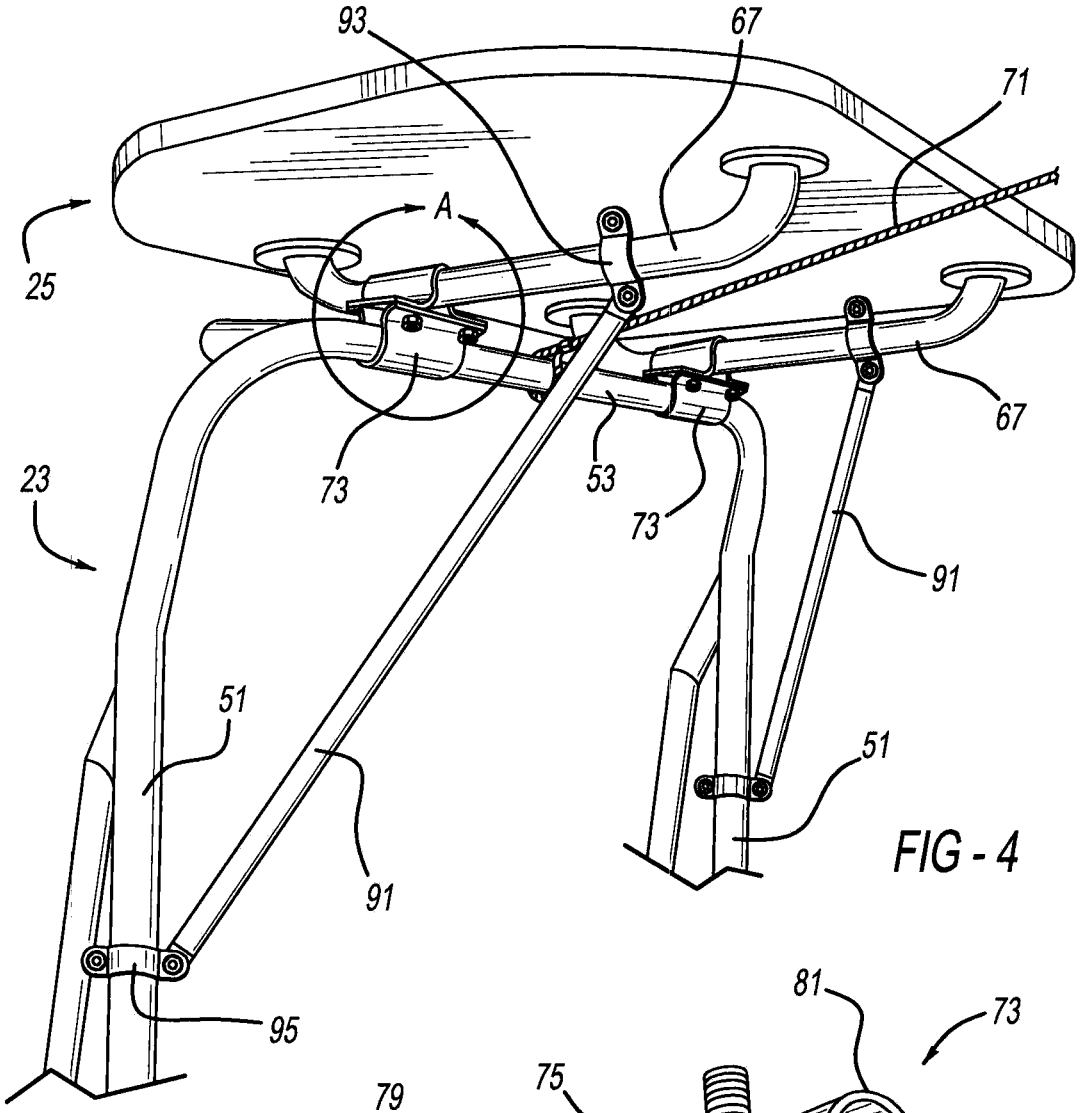
FIG. 4 is a bottom perspective view showing the table and ski rope tow bar assembly.
Figure 8:
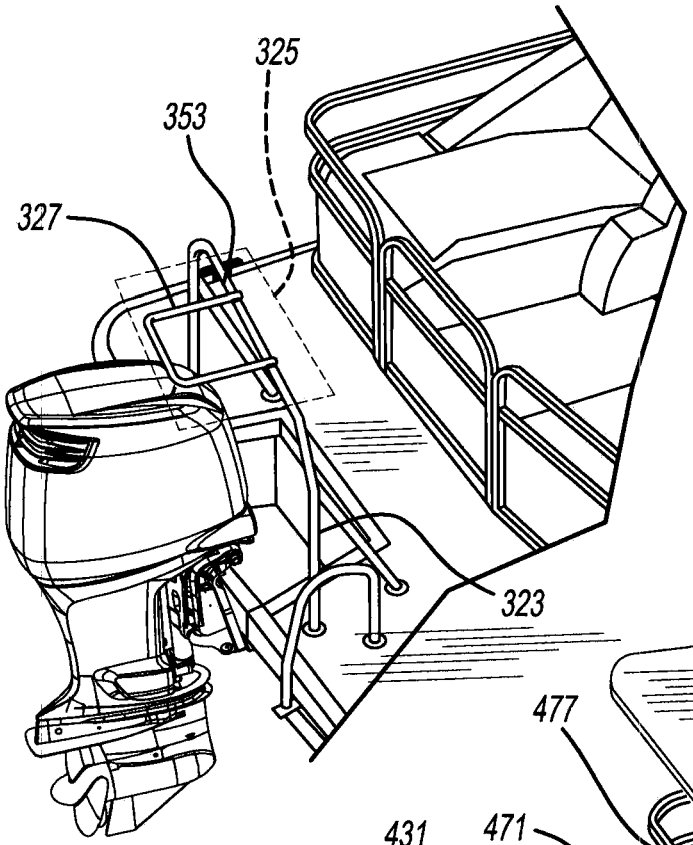
FIG. 8 is a perspective view showing a different variation of a ski rope tow bar for a table.

Yet another embodiment is shown in FIG. 8. A structural halo member 327 is welded or otherwise fastened to a horizontal member 353 of a ski rope tow bar 323. A larger sized table 325, such as that employed with the embodiment of FIG. 2, is directly mounted upon halo member 327 without requiring additional vertical spacing between the underside of table 325 and horizontal member 353 allowing ski tow rope access thereto. Optionally, however, additional washer-like spacers or extension brackets can be employed between an underside of table 325 and halo 327 if it is desired to secure the ski tow rope to halo 327 itself. No diagonal brace is required for this version.

Figure 9:
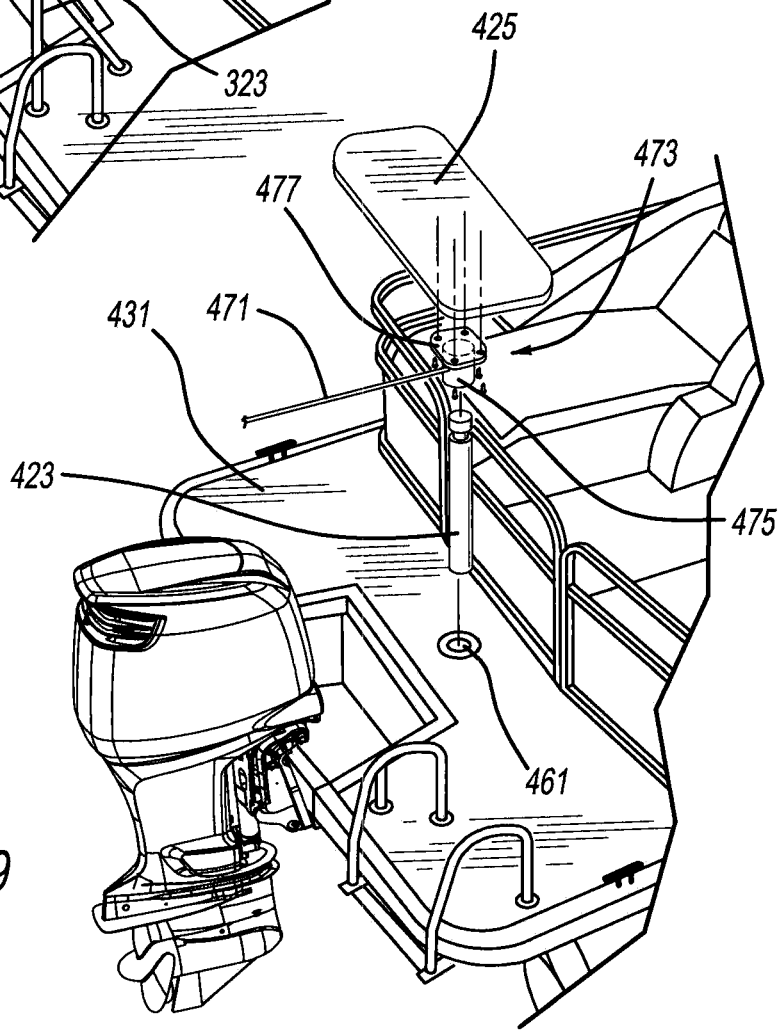
FIG. 9 is an exploded perspective view showing a different variation of ski row tow bar mounted to a table.

Reference should now be made to FIG. 9. A different embodiment of a ski rope tow bar 423 is configured as a vertically elongated and cylindrical post which can be removeably inserted into a cup-like receptacle 461 in deck 431. A mounting bracket 473 has a cylindrical and hollow sleeve 475 for fitting around an upper end of tow bar 423 while a flange 477 is screwed into an underside of table 425. A cotter pin, bolt or other fastener may be horizontally inserted through an external hole in sleeve 475 and received within a matching hole or undercut of tow bar 423 to secure the two together. Additionally, a water ski tow rope 471 can be inserted into a hole in sleeve 475 for securing to tow bar 423. It is again noteworthy that table 425 is positioned outside of the normal seating area of the pontoon boat while also advantageously allowing the multifunctional use of tow bar for attachment by the ski rope.

Figure 10:
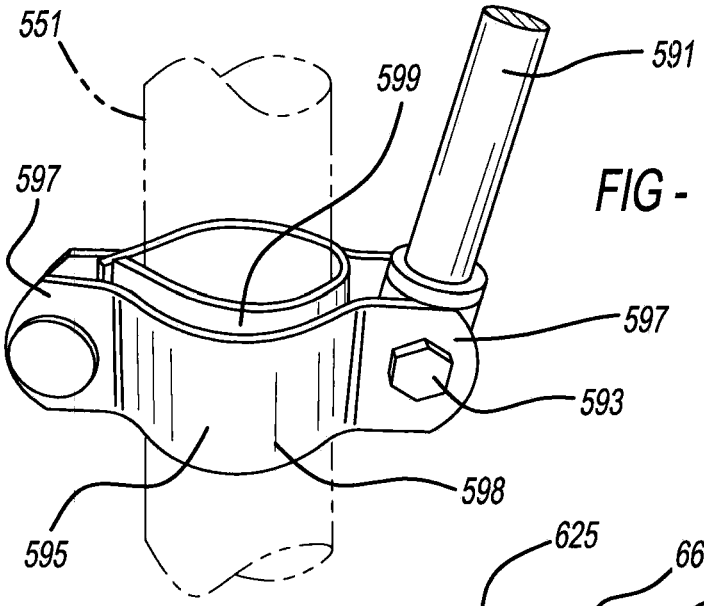
FIG. 10 is a partially fragmented, top elevational view showing a mounting bracket taken within circle B of FIG. 6.
Figure 13:
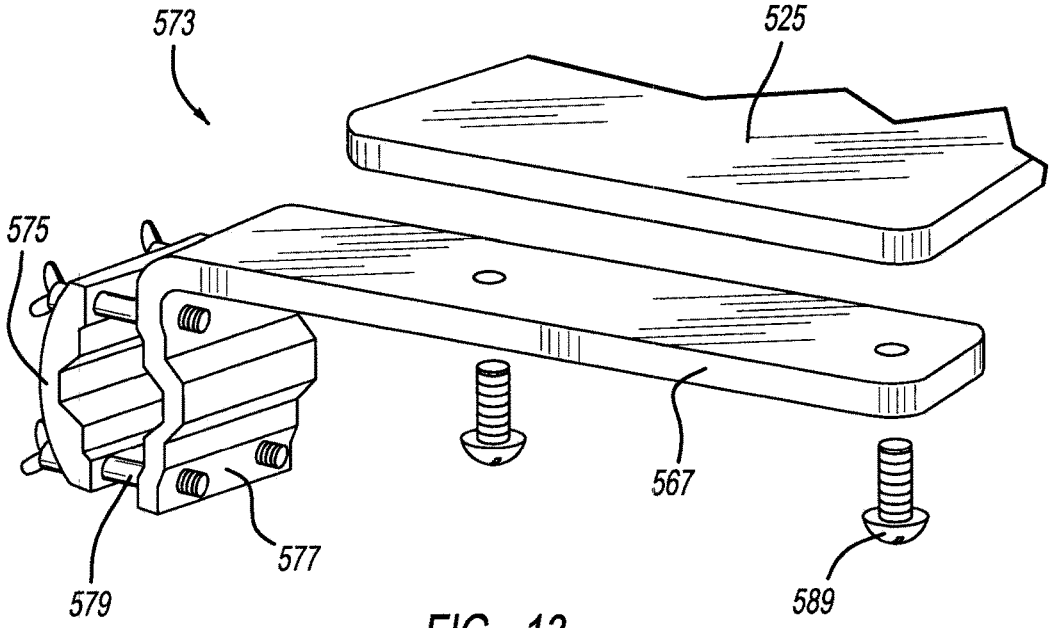
FIG. 13 is an exploded perspective view showing a mounting bracket employed with the side rail mounted table of FIG. 11.

Reference should now be made to FIGS. 6, 10 and 13. A side table 525 is mounted to a generally horizontally elongated side rail 553 by way of a mounting bracket 573. Mounting bracket includes a somewhat C-shaped clamping half 575 and an oppositely disposed clamping body 577. Threaded thumb-screw fasteners 579 secure together clamping half 575 and clamping body 577 about a polygonal cross section of side rail 553 in two or more locations. Elongated shoulder 567 outwardly projects in an outboard manner from clamping body 577 such that table 525 is attached thereupon by way of threaded screw fasteners 589. Additionally, one or more diagonal braces 591 are coupled to a bottom of either table 525 directly or indirectly via shoulder 567. A bottom end of each brace 591 is coupled to a generally vertical member 551 of the side rail assembly by way of a mounting bracket 595. Threaded bolts 593 secure together flanges 597 bordering generally C-shaped center sections 59 of clamping bracket 595 in a snug manner around member 551. While vertical member 551 is shown as a hollow tubular cross-sectional shape, it should be appreciated that it may alternately have a generally polygonal cross-sectional shape with the interior surface of bracket 595 also being of a matching polygonal shape. A flexible elastomeric or rubber pad 599 is located between center sections 598 and member 551. Diagonal brace 591 is also coupled to bracket 595 by one of bolts 593.

Figure 11:
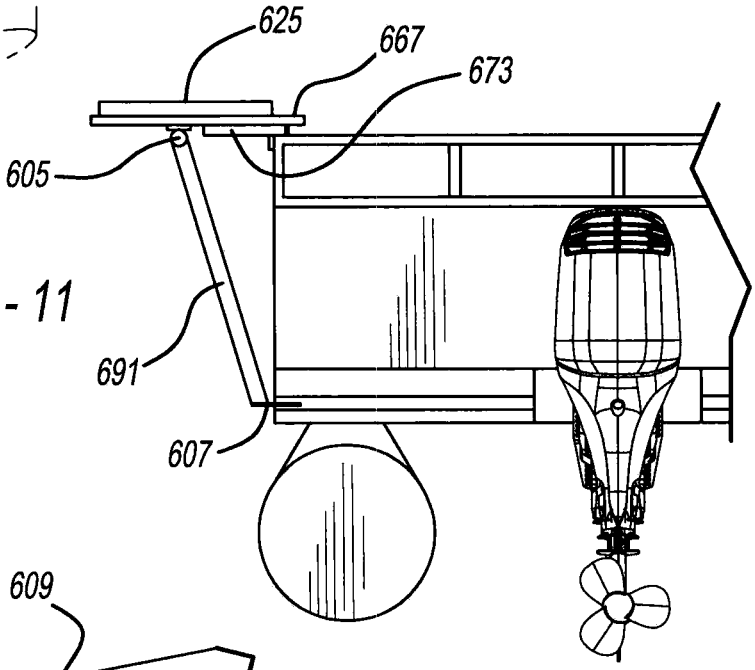
FIG. 11 is a rear elevational view showing a different variation of a side rail mounted table.
Figure 12:
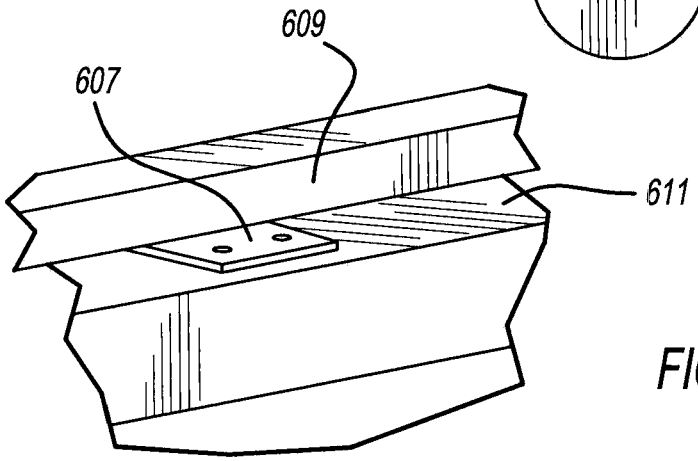
FIG. 12 is a perspective view from inside a boat showing a portion of the side rail mounted table of FIG. 11.

A different embodiment of the side table configuration is illustrated in FIGS. 11 and 12. Here, table 625 is mounted upon rails 667 pivotally coupled to a shoulder of a mounting bracket 673 clamped or screwed to a horizontal side rail. A diagonally elongated brace 691, preferably a single brace, is coupled to an underside of table 625 or rail 665 by a pivoting joint 605. Brace 691 is telescopically extendable with a fastener to secure the desired length. A laterally and projecting inboard elongated foot plate 607, attached to a bottom end of brace 691 is removeably positioned between a pair of parallel existing rail or frame structures 609 and 611. Alternately, foot plate 607 fits within the already present space between structural rail member 609 and a deck surface. When foot 607 is removed from the space between members 609 and 611, the boat occupant can upwardly or downwardly rotate table 625 to a somewhat vertical plane when the table is not in use. This foot arrangement is ideally suited when rigid vertical panels span between the rails. As with the rear tow bar table, the side table is advantageously outboard of the normal seating area and deck usage space of the boat occupants. Differing sized tables can be employed which add to the usable space of the boat beyond the fixed deck area.

Figure 14:
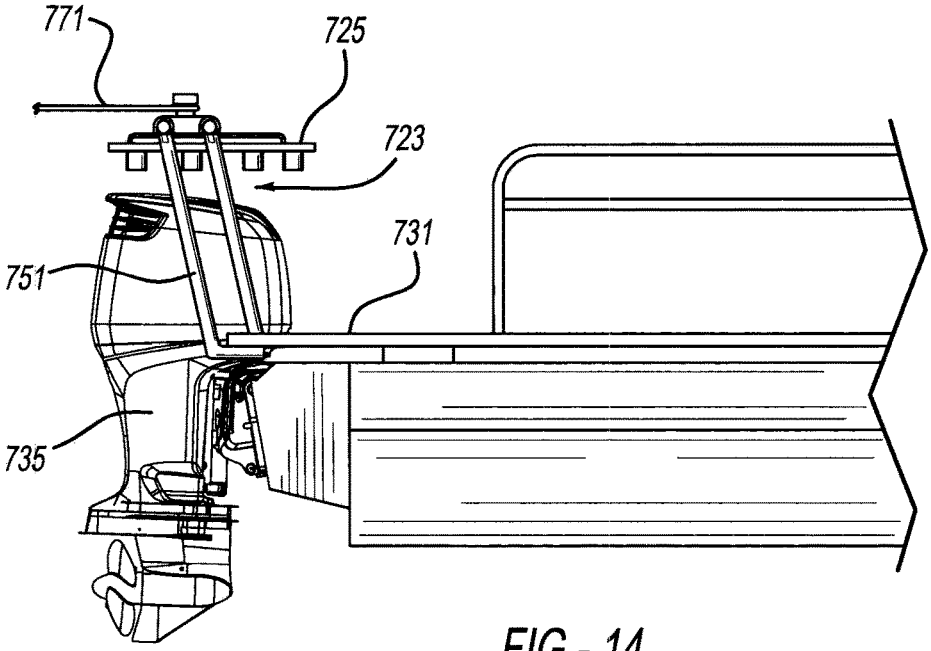
FIG. 14 is a side elevational view showing another embodiment, under-mount version of a boat table with a taller height ski rope tow bar mounted adjacent an outboard motor.

FIGS. 14-6 show another embodiment wherein a generally flat table 725 is mounted below and to an underside of one or more generally horizontal tubular members 753. Members 753 are elongated in a cross-boat direction spanning between left and right diagonally upstanding tubular members 751. Members 751 and 753 define part of the structure of a ski-rope tow bar 723 mounted to a boat deck 731. Ski-rope tow bar further includes a central steel or aluminum brace 701 welded on top of and connecting horizontal members 753. A cylindrical stem 703 and enlarged cylindrical head 705 are welded to and upwardly extend from brace 701. A ski rope 771 has a loop secured to stem 703, such that the tow rope is freely pivotable above table 725 and will not obstruct beverages located within cup-shaped hollow holders 763. Holders 763 are removeably retained within holes in table 725 and downwardly extend therefrom.

Figure 5:
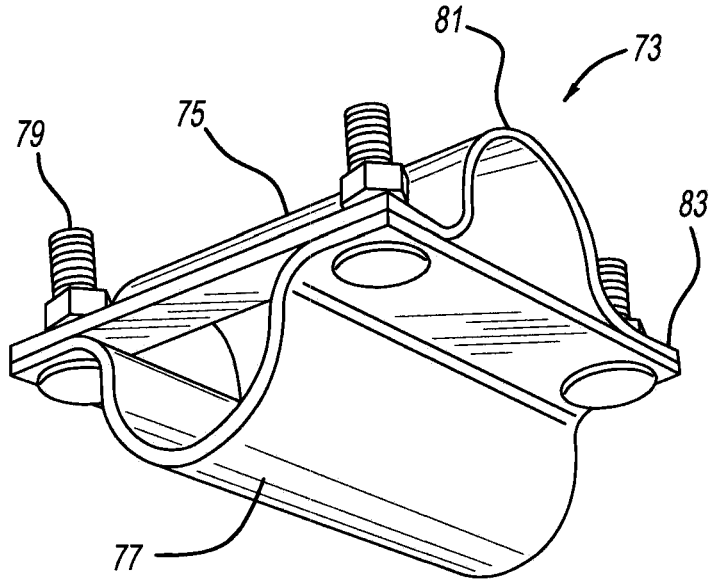
FIG. 5 is a perspective view showing a mounting bracket within circle A of FIG. 4.

Table 725 has a pair of fore-aft elongated bars 767 affixed to an upper surface thereof by way of screws or rivets. Bars 767 are essentially perpendicular to and cross horizontal members 753. Pipe clamps or brackets 773 couple bars 767 to members 753 such as is shown in FIG. 5. As will be discussed in greater detail with regard to the next embodiment, a turnbuckle or other adjuster, or optional spacers can be placed between bars 767 and members 753 if height adjustment or other angular differences are desired depending on the outboard motor 735 sizing or tilting clearance since the motor is at least partially located directly below the table, and to place the table a comfortable waist or chest height distance above the deck (e.g. 36-48 inches) depending on the tow bar model employed or user's height.

Figure 15:
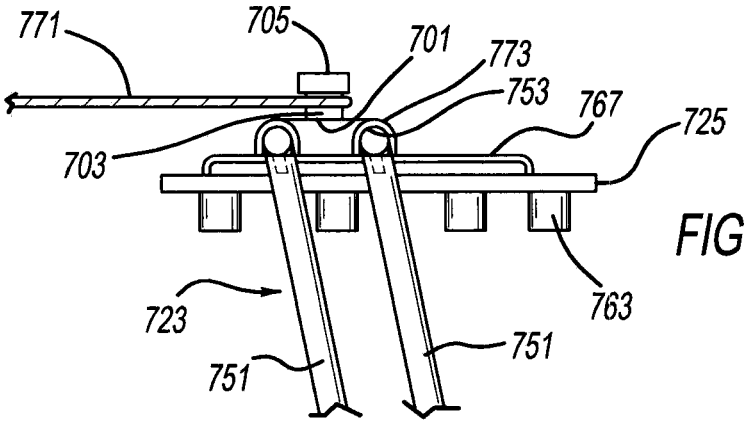
FIG. 15 is an enlarged side elevational view showing the boat table embodiment of FIG. 14.
Figure 16:
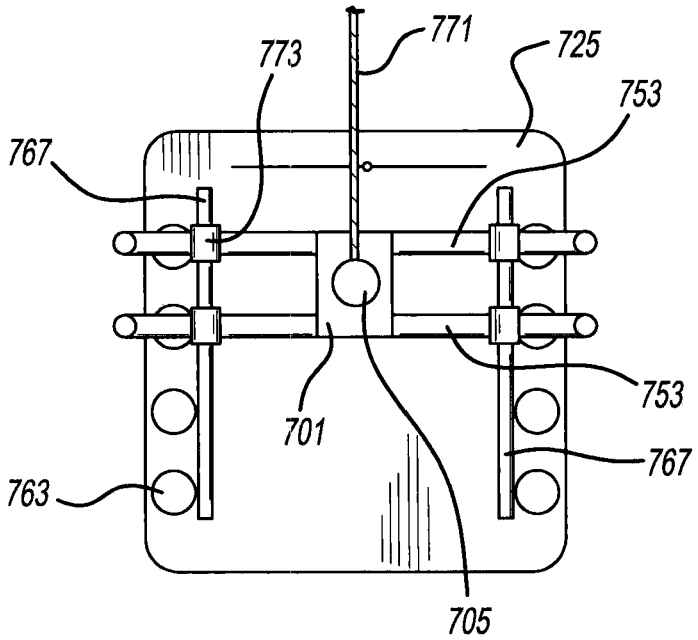
FIG. 16 is a top elevational view showing the boat table embodiment of FIG. 14.
Figure 17:
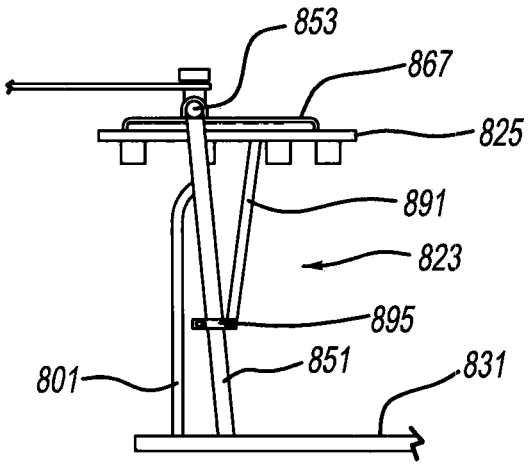
FIG. 17 is a side elevational view showing another embodiment of a boat table and ski rope tow bar.

FIG. 17 illustrates a table 825 and bars 867 like that of FIG. 15, except they are mounted to a single horizontal cross member 853 of a ski tow bar 823. A diagonal brace 891 connects a bottom of table 825 to a generally vertical member 851 via pivotable bracket, and a clamp 895 (such as in FIG. 10) can be loosened to tilt table about member 853 if clearance is needed to access or pivot the outboard engine located directly therebelow. A secondary substantially vertical post 801 also structurally connects member 851 to a boat deck 831.

Figure 18:
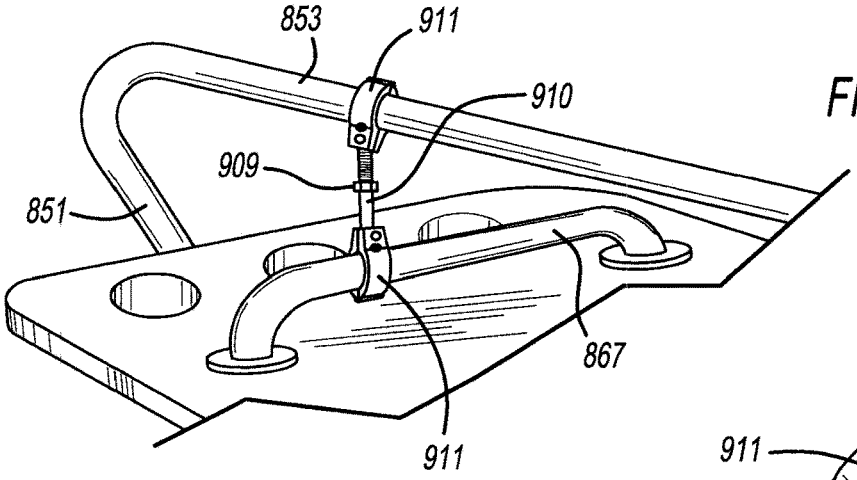
FIG. 18 is a fragmentary top perspective view showing the boat table and ski rope tow bar of FIG. 17.
Figure 19:
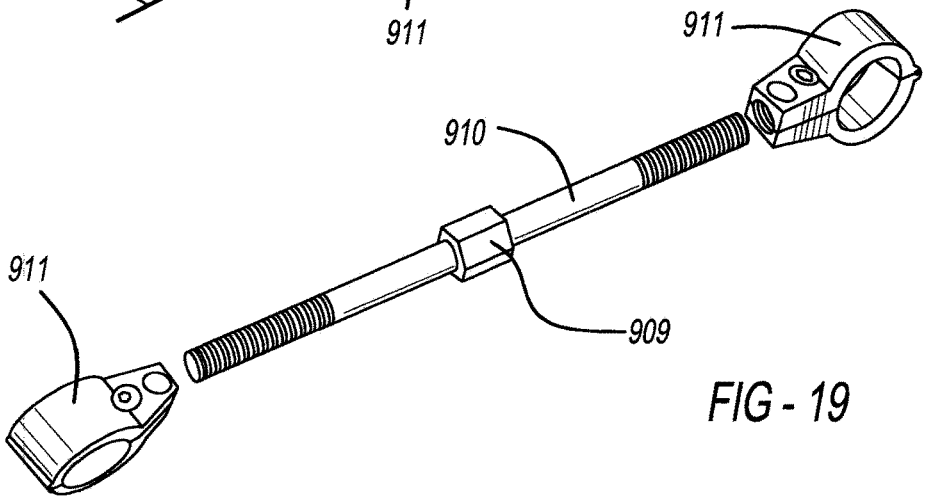
FIG. 19 is an exploded perspective view showing an adjustment mechanism employed with any of the embodiments disclosed herein.
Figure 20:
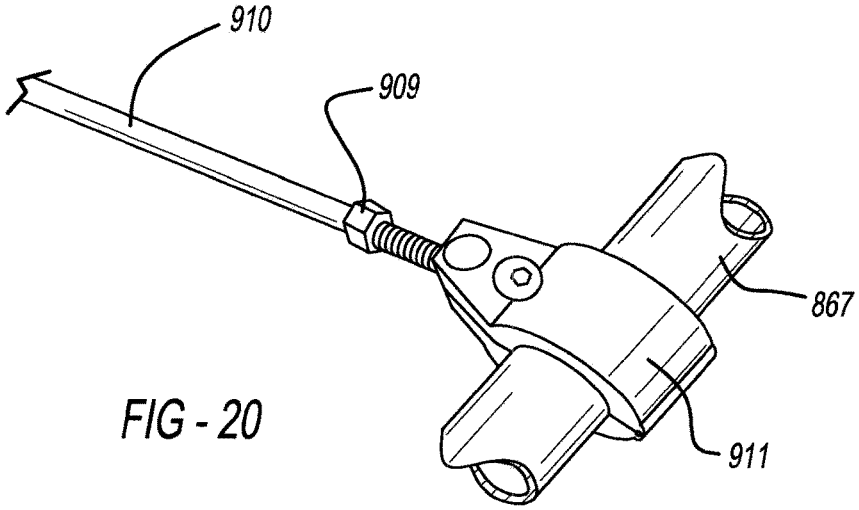
FIG. 20 is a perspective view showing the adjustment mechanism.

An optional turnbuckle adjuster 909 (see FIGS. 18-20) is coupled to horizontal member 853 by a bolt-secured pipe clamp 911 with a pivotable and internally threaded nut to receive an externally threaded end of the central rod 910. The other end of the central rod is pivotably coupled to bar 867 attached to the top of table 25. This turnbuckle arrangement is on both lateral sides of the table. Adjuster 909 allows manual raising and lowering of the table by up to about two inches, and a longer turnbuckle can be used in its place if a larger tow bar-to-table spacing is desirable (e.g., four inches or more). It is also noteworthy that turnbuckle adjusters 909 can be optionally employed to adjust the length of members 91, 591, 691, 751, 891, or the like, so that the table height or angle can be varied for any of the embodiments discussed herein.

Figure 21:
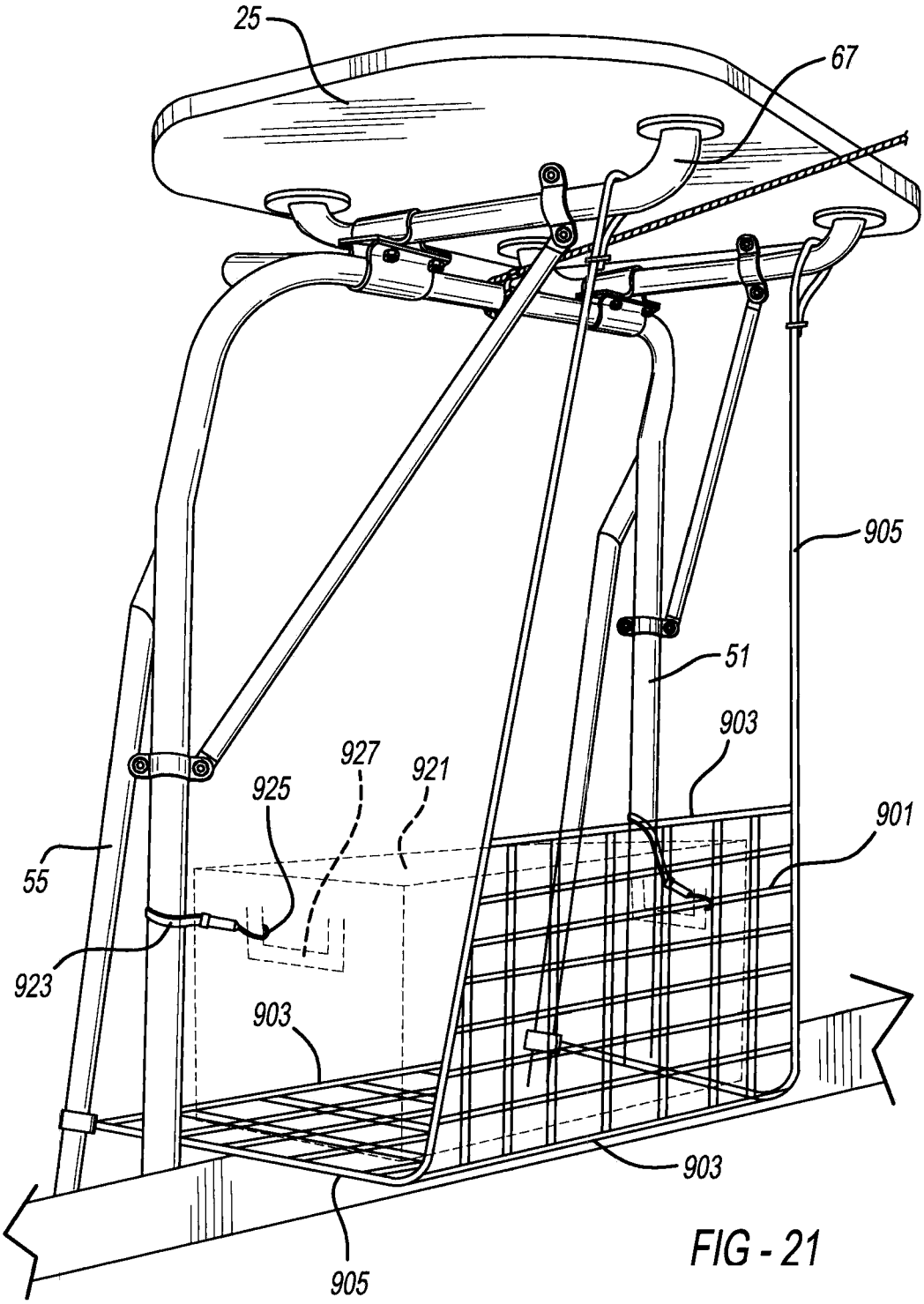
FIG. 21 is a bottom perspective view showing a cooler support employed with another embodiment of a boat table and ski rope tow bar.
Figure 22:
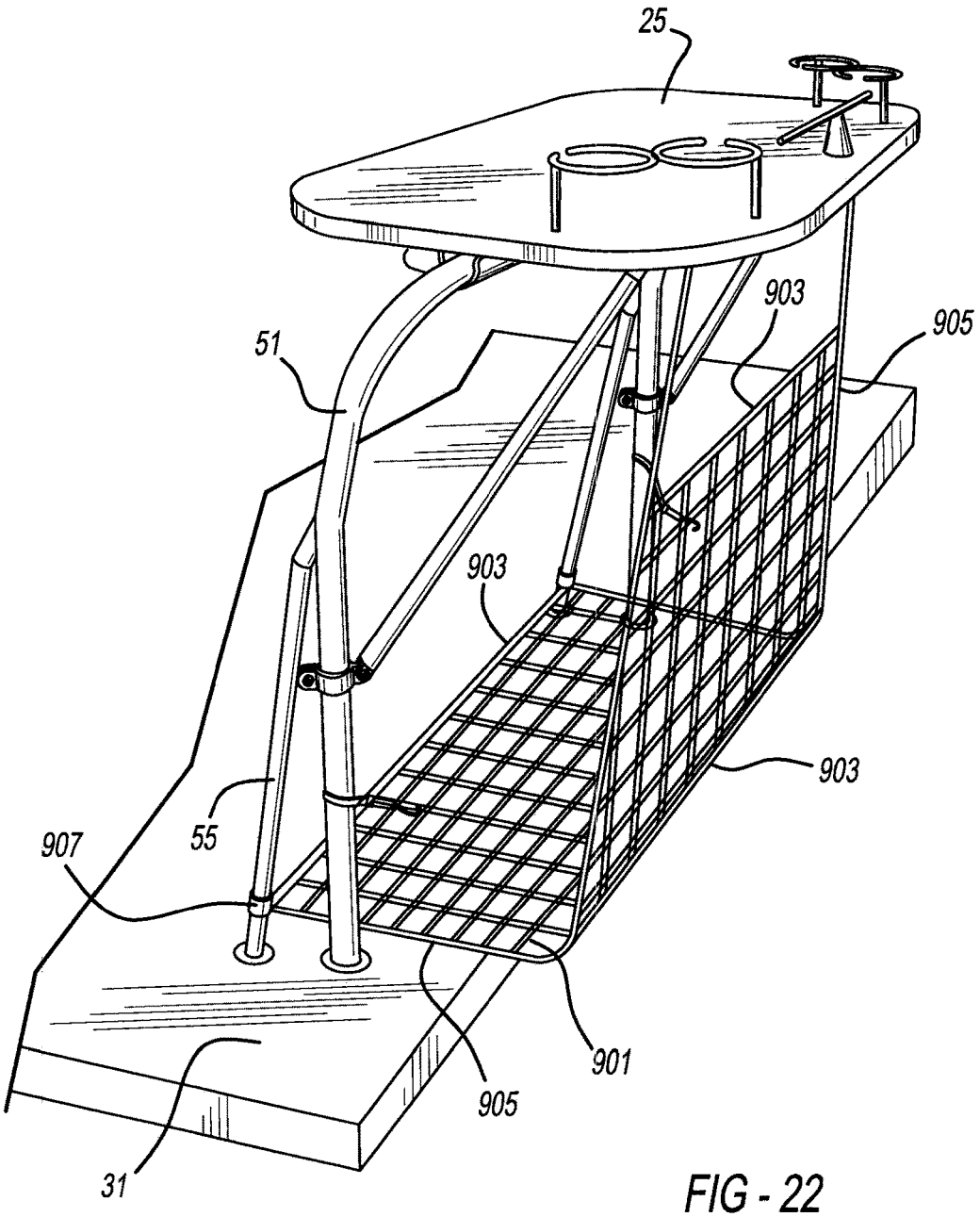
FIG. 22 is a top perspective view showing the cooler support and boat table of FIG. 21.

Reference should now be made to FIGS. 21 and 22. A flexible cargo support 901, such as a net includes a webbing of nylon or other polymeric fabric straps formed in a repeating crossing pattern. This flexibility allows for adjustment to hold any existing sized, portable cooler within the dimensions of the tow bar. Flexible steel or aluminum rods 903 reinforce sections of net 901 and are located within pockets or loops of some of the straps in a spaced apart manner. The net can be moved forward without detachment when motor tilting is desired, when the cooler is absent. Alternately, support 901 may be a moveable or fold-down rigid shelf pivotably coupled to vertical members 51 by clamps such as that shown in FIG. 10. Alternately, support 901 can be a flexible woven fabric sling or thin polymeric sheet. For many boats, motor mounts including motor fuel lines and steering mechanisms are located in the area below the table and forward of the motor so a cooler cannot be placed on the deck at this area. Thus, the present support 901 beneficially spaces the cooler above the motor mounting area and deck to maximize the useable deck space. Alternately, a storage box or container for holding bumpers or other parts can be used in place of the cooler storage container.

Elongated and somewhat flexible guides 905 have a generally L-shape and are secured within end loops or pockets at the outboard sides of net 901. A lower and forward end of each guide 905 is removeably coupled to support member 55 via a bracket 907 and bars 903, such as like 1024 and 1053 of FIG. 23. A holding area of net 901 is accessible from the front such that a beverage cooler 921 can be placed thereon offset spaced above the deck (with a gap therebetween), in otherwise unused space between the vertical members of the tow bar. This provides synergistic benefits. Flexible and adjustable length straps 923 have hooks 925 on ends thereof for removeable engagement with handles 927 of cooler 921. Straps 923 are looped around or riveted to upstanding structural members 51. Alternately, a light gage and non-stretchable chain or wire, with a hook, will attach to post members 51 and through cooler handles 927 to deter lateral motion of the cooler.

Figure 23:
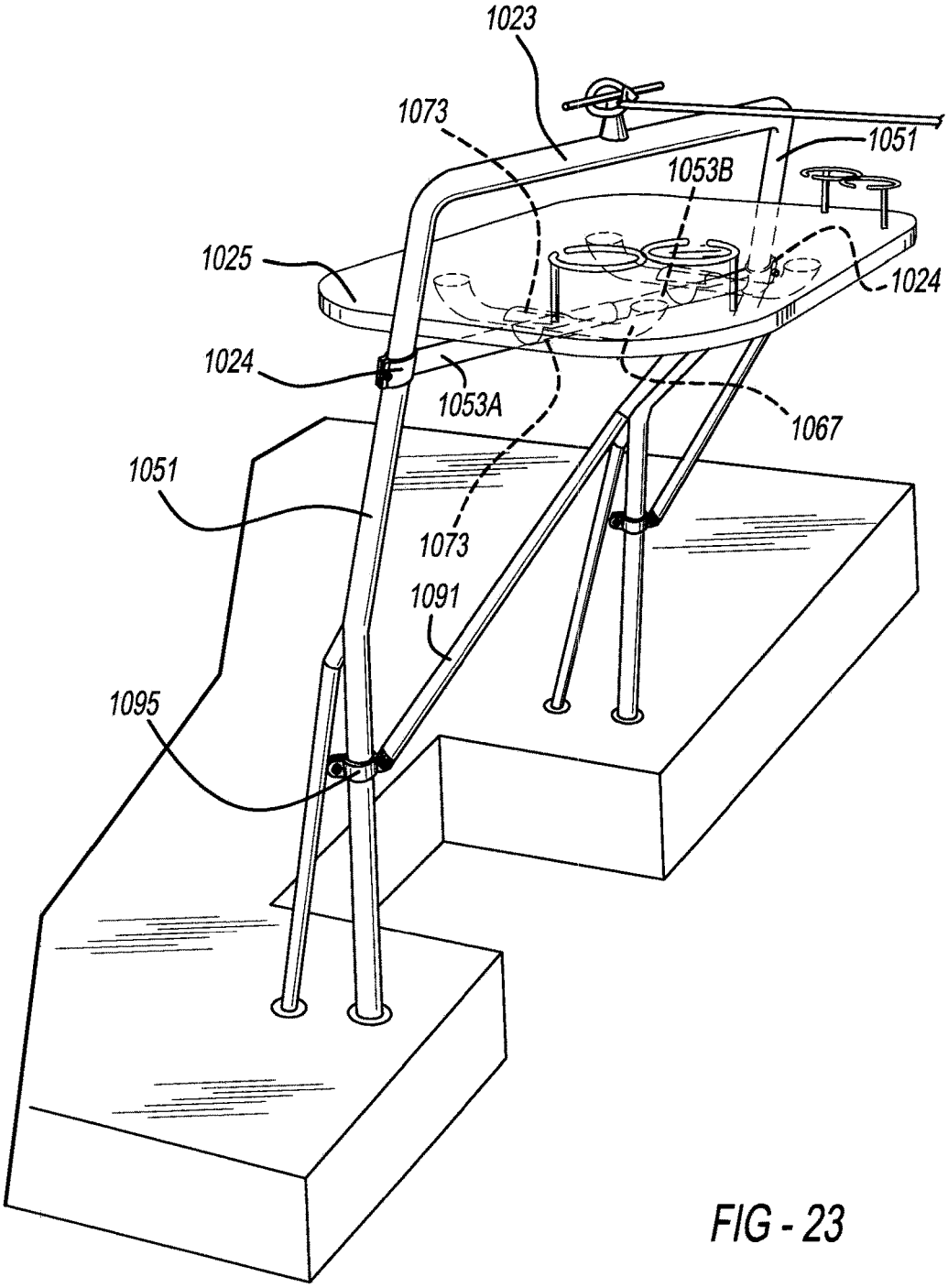
FIG. 23 is a top perspective view showing another embodiment of a boat table and ski rope tow bar.

FIG. 23 illustrates another embodiment of a table 1025 coupled to a telescopically extendable pair of generally horizontal bar members 1053A and 1053B. Members 1053A and 1053B are coupled to generally vertically extending post members 1051 of a ski rope tow bar 1023, by vertically adjustable brackets or clamps 1024. A pair of perpendicularly accessible U-brackets 1073 couple bar members 1053A and 1053B to fore-and-aft elongated rails 1067 mounted to a top surface of table 1025, allowing for fore-and-aft adjustability of the table relative to the tow bar. Diagonal struts 1091 couple a bottom of table 1025 to vertical members 1095 via adjustable clamps 1095.

While various embodiments of the present boat table have been disclosed, it should be appreciated that other variations are possible. For example, differently shaped brackets and members may be employed although certain of the disclosed advantages may not be fully realized. Furthermore, recesses or holes in a top surface of any of the tables disclosed herein can be optionally added to receive beverage cups or dishes, although care must be taken to avoid interference of a downwardly protruding cup with an underlying ski tow rope if the top-mounted table is mounted to a ski tow bar; thus holes in the table are better suited for the side rail table and bottom-mounted table rather than top-mounted table/ski tow bar embodiments. Optionally, the diagonal brace may be telescopically adjustable for any of the tow bar or table embodiments discussed hereinabove. Moreover, a universal table is envisioned that has two bars on both the top and bottom of the tables, or with rectangularly elongated frames mounted to and extending perpendicularly to the large table surface, so that the same table can be top or bottom mounted to one or more horizontal structural members. It should also be appreciated that fastening welds, rivets or separate fasteners may be used in place of one or more of the disclosed brackets, although some of the present after-market retrofit and adjustability benefits may not be achieved. The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A boat apparatus comprising:

a ski rope tow bar comprising a pair of substantially vertical tubes and a substantially horizontal tube spanning between the vertical tubes;

a table mounted to the ski rope tow bar, the table further comprising a substantially flat and horizontal top;

the table being located directly above or below a tow rope-retention section of the bar; and at least one mount coupling the table top to the substantially horizontal tube of the ski rope tow bar.

2. The boat apparatus of claim 1, further comprising:

a boat deck;

bottom ends of the substantially vertical tubes of the ski rope tow bar being mounted to the boat deck; and a ski rope removeably mounted to the ski rope tow bar while the table is also coupled to the ski rope tow bar.

3. The boat apparatus of claim 1, further comprising diagonal braces coupling the table to the substantially vertical tubes of the ski rope tow bar, and a top surface of the tow bar being within 48 inches of a boat deck upper surface, and cupholders and at least one containment rail being affixed to a top of the table.

4. A boat apparatus comprising:

a ski rope tow bar;

a table mounted to the ski rope tow bar, the table being located directly above or below a tow rope-retention section of the bar;

the ski rope tow bar consisting exclusively of a substantially vertically elongated post with a rope attachment receptacle adjacent to an upper end thereof; and a bracket coupling the table on top of the upper end of the post.

5. A boat apparatus comprising:

a ski rope tow bar;

a table mounted to the ski rope tow bar, the table being located directly above or below a tow rope-retention section of the bar;

a pontoon boat including a seating area and a deck;

an outboard motor moveably coupled to the pontoon boat adjacent a rear edge of the deck;

the ski rope tow bar being mounted to the deck and allowing at least a portion of the table to overhang above the outboard motor; and the table being spaced away from the seating area to allow a boat occupant to walk therebetween.

6. A boat apparatus comprising:

a ski rope tow bar;

a table mounted to the ski rope tow bar, the table being located directly above or below a tow rope-retention section of the bar; and an adjuster allowing a variation in a length of an elongated member coupled to a bottom of the table.

7. The boat apparatus of claim 5, further comprising a moveable cargo support coupled to and spaced below at least one of: the table and the tow bar.

8. The boat apparatus of claim 7, further comprising a storage container removeably retained to the tow bar below the table and spaced above a plane of a boat deck, by the cargo support which is moveable.

9. A boat apparatus comprising:

a substantially horizontal member;

upstanding members attached to and supporting the horizontal member;

a middle area of a table overlapping with the horizontal member;

a mount coupling the table to the horizontal member such that at least a majority of the table is located outboard of the members; and at least one diagonal brace coupling the table to at least one of the upstanding members.

10. The boat apparatus of claim 9, wherein the members define a ski rope tow bar.

11. The boat apparatus of claim 9, wherein the members are side rails bordering a boat seating area.

12. The boat apparatus of claim 9, wherein the diagonal brace is moveable to allow the table to be rotated from a substantially horizontal plane to a substantially vertical plane.

13. The boat apparatus of claim 9, further comprising:

a boat deck upon which bottom ends of the upstanding members are coupled; and an outboard motor moveably coupled adjacent a rear edge of the boat deck;

the members being positioned adjacent the rear edge of the boat deck to allow at least a portion of the table to overhang above the outboard motor.

14. The boat apparatus of claim 9, further comprising at least one fore-and-aft elongated member located between and attached to the table and the substantially horizontal member.

15. The boat apparatus of claim 9, wherein the table is located above the horizontal member.

16. The boat apparatus of claim 9, wherein the table is located below the horizontal member.

17. The boat apparatus of claim 9, further comprising an adjuster allowing a variation in a length of an elongated member coupled to a bottom of the table.

18. The boat apparatus of claim 9, further comprising a moveable cargo support coupled to at least one of: the table and the tow bar.

19. The boat apparatus of claim 18, further comprising a storage container removeably retained to the tow bar below the table and spaced above a plane of a boat deck, by the cargo support.

20. A boat apparatus comprising:

a substantially inverted-U shaped tow bar including upstanding members and a cross member spanning between the upstanding members;

a table located above or below the tow bar;

at least one fastener attaching the table to the cross member; and at least one diagonal member coupling an underside of the table to at least one of the upstanding members.

21. The boat apparatus of claim 20, further comprising:

a boat deck;

bottom ends of the upstanding members of the tow bar being mounted to the boat deck; and a ski rope removeably mounted to the tow bar while the table is also coupled to the tow bar.

22. The boat apparatus of claim 20, further comprising:

a pontoon boat including a seating area and a deck;

an outboard motor moveably coupled to the pontoon boat adjacent a rear edge of the deck;

the tow bar being mounted to the deck and allowing at least a portion of the table to overhang above the outboard motor; and the table being spaced away from the seating area to allow a boat occupant to walk therebetween.

23. The boat apparatus of claim 20, further comprising beverage holders mounted to and upstanding from the table.

24. The boat apparatus of claim 20, further comprising a moveable cargo support coupled to at least one of: the table and the tow bar, and the cargo support being spaced above an outboard motor mounting area.

25. A boat apparatus comprising:

a side rail including upstanding members and a cross member spanning between the upstanding members;

a table located above the side rail;

at least one bracket attaching the table to the cross member;

a diagonal brace coupled to the table; and a foot inwardly projecting adjacent a distal end of the diagonal brace, the foot being adapted for insertion between a pair of horizontally elongated boat structures.

26. The boat apparatus of claim 25, further comprising a pivotable joint coupling a proximal end of the diagonal brace to the table and the foot being removeably mounted between the boat structures to allow the table to be rotated relative to the cross member to which it is mounted.

27. The boat apparatus of claim 25, wherein at least a majority of the table extends outboard from a pontoon boat, and the cross member is part of a side rail outwardly bordering an occupant seating area.

28. The boat apparatus of claim 25, further comprising beverage holders mounted to and upstanding from the table.

29. A boat apparatus comprising:

a pontoon boat including a deck, a seating area and rails substantially surrounding the seating area inboard of a periphery of the deck;

an outboard motor moveably coupled to the boat adjacent a rear edge of the periphery;

at least one upstanding post coupled to the deck between the rear edge and the rails;

at least one substantially horizontal member attached to the post;

a table coupled to the horizontal member, the table including at least one of: (a) a beverage container-holder or (b) a dish-holder; and at least a portion of the table overhanging the outboard motor.

30. The boat apparatus of claim 29, wherein the post and horizontal member are part of a ski rope tow bar, and a top surface of the tow bar is within 48 inches of an upper surface of the deck.

31. The boat apparatus of claim 29, further comprising at least one fore-and-aft elongated member located between and attached to the table and the substantially horizontal member.

32. The boat apparatus of claim 29, wherein the holder upstands from a top of the table.

33. The boat apparatus of claim 29, wherein the holder is below a top of the table, and the table is adjustably mounted to the horizontal member.

34. The boat apparatus of claim 29, wherein the table is spaced away from the horizontal member to allow ski tow rope clearance therebetween.

35. The boat apparatus of claim 29, further comprising a diagonal brace coupling the table to the post.

36. The boat apparatus of claim 29, further comprising a moveable cargo support coupled to at least one of: the table and the tow bar.

37. The boat apparatus of claim 6, wherein the elongated member is a brace coupling the table to the tow bar, and rotation of the adjuster operably adjusts a length of the brace.

38. The boat apparatus of claim 37, wherein the adjuster includes a threaded segment and the brace diagonally extends from adjacent a rearmost half of the table to a vertically elongated section of the tow bar.

39. The boat apparatus of claim 6, wherein the adjuster is a turnbuckle that allows raising and lowering of at least a portion of the table.

40. The boat apparatus of claim 4, further comprising a rear rail outwardly bordering an occupant seating area, and the post being located between a rear-mounted engine and the rear rail.

41. The boat apparatus of claim 4, further comprising a pontoon boat deck and the post is removeable from a receptacle in the deck, and the bracket includes a cylindrical and hollow sleeve fitting around an upper end of the post.

42. The boat apparatus of claim 5, wherein:

the ski rope tow bar further comprises a pair of substantially vertical tubes and a substantially horizontal tube spanning between the vertical tubes;

the table further comprises a substantially flat and horizontal top;

bottom ends of the substantially vertical tubes of the ski rope tow bar being mounted to the deck; and a ski rope removeably mounted to the ski rope tow bar while the table is also coupled to the ski rope tow bar.

43. The boat apparatus of claim 5, wherein:

the ski rope tow bar further comprises a pair of substantially vertical tubes and a substantially horizontal tube spanning between the vertical tubes;

the table further comprises a substantially flat and horizontal top;

diagonal braces coupling the table to the substantially vertical tubes of the ski rope tow bar;

a top surface of the tow bar being within 48 inches of an upper surface of the deck; and cupholders being affixed to the table.

* * * * *